US008647241B2

(12) United States Patent
Walton

(10) Patent No.: US 8,647,241 B2
(45) Date of Patent: Feb. 11, 2014

(54) SUPINE CYCLING EXERCISE MACHINE WITH A USER REPOSITIONABLE CRANKARM AND METHOD OF USE

(76) Inventor: Christopher E. Walton, Miami, FL (US)

( * ) Notice: Subject to any disclaimer, the term of this patent is extended or adjusted under 35 U.S.C. 154(b) by 191 days.

(21) Appl. No.: 13/180,369

(22) Filed: Jul. 11, 2011

(65) Prior Publication Data

US 2013/0017930 A1 Jan. 17, 2013

(51) Int. Cl.

| | |
|---|---|
| ***A63B 23/14*** | (2006.01) |
| ***A63B 22/06*** | (2006.01) |
| ***A63B 69/10*** | (2006.01) |

(52) U.S. Cl.
USPC ..... 482/57; 482/62

(58) Field of Classification Search
USPC ..... 482/57–65
See application file for complete search history.

(56) References Cited

U.S. PATENT DOCUMENTS

| | | | | |
|---|---|---|---|---|
| 4,880,225 | A * | 11/1989 | Lucas et al. | 482/59 |
| 5,902,215 | A * | 5/1999 | Kuo | 482/57 |
| 6,413,192 | B2 * | 7/2002 | Abelbeck | 482/57 |
| 2003/0022765 | A1 * | 1/2003 | Wu | 482/92 |

* cited by examiner

*Primary Examiner* — Loan Thanh
*Assistant Examiner* — Jennifer M Deichl
(74) *Attorney, Agent, or Firm* — CUSPA Technology Law Associates; Yi Li

(57) ABSTRACT

A supine cycling exercise machine includes a frame attached to a horizontal base and a rotation driving assembly supported by the frame. The driving assembly includes a rotatable crankshaft and two crankarms with proximal ends thereof attached to opposite ends of the crankshaft, with two pedals attached to distal ends of the crankarms. One or more crankarm includes a redirection connection mechanism at the proximal end thereof, and such a crankarm is adapted to be repositioned by an exerciser between an opposing and a parallel orientation relative to the other crankarm. The exercise machine can be used for two different cycling exercises, with either a reciprocating motion or a parallel motion of the exerciser's feet.

14 Claims, 12 Drawing Sheets

SUPINE CYCLING EXERCISE MACHINE WITH A USER REPOSITIONABLE CRANKARM AND METHOD OF USE

FIELD OF THE INVENTION

The present invention relates to a cycling exercise machine, more specifically relates to a supine cycling exercise machine that has a user repositionable crankarm and method of use in performing different modes of cycling exercises.

BACKGROUND OF THE INVENTION

Exercise devices to facilitate cycling or rotary exercise of a user in a supine or face-up position is known in the art. These devices have been used for leg and abdominal exercises. Some devices also have mechanism for facilitating rotary exercise of the user's arms.

However, the existing devices are only to be used to facilitate one motion of movement, namely, rotary or cycling movement with two feet (or arms) moving in a reciprocating motion. This only provides exercise of abdominal muscles that are actively involved in the reciprocating cycling motion. Moreover, the existing devices are either used to facilitate movement of feet or arms at one time, but not facilitate movements of both legs and arms at the same time.

Therefore, there is a need for a rotary or cycling exercise device that can facilitate two different cycling exercises, namely reciprocating motion and parallel motion of the user's feet to provide more effective workout of different muscles. It is further desirable for an improved device that provides rotary exercise of both legs and arms at the same time. Moreover, it is particularly desirable for an improved device that has a user adjustable mechanism to change the mode of exercise from one to the other between the reciprocating and the parallel motion.

SUMMARY OF THE INVENTION

In one aspect, the present invention is directed to a supine cycling exercise machine. In one embodiment, the supine cycling exercise machine comprises a frame, disposed on a horizontal base, and a rotation driving assembly supported by said frame, said driving assembly comprising a rotatable crankshaft and two crankarms with proximal ends thereof attached to opposite ends of said crankshaft and distal ends thereof attached to two pedals, a redirection connection mechanism between at least one crankarm at proximal end thereof and at least one end of said crankshaft, enabling repositioning said at least one crankarm by an exerciser between an opposing and a parallel orientation relative to the other crankarm, thereby said exercise machine is adapted to provide two different cycling exercises. The cycling exercises include reciprocating motion or parallel motion of the exerciser's feet/legs.

In a further embodiment, the exercise machine further comprises two elongated extension shafts, each having one end thereof removably attached to an outer side of a corresponding pedal. With this embodiment, the cycling exercises further include reciprocating motion or parallel motion of the exerciser's arms.

In a further aspect, the present invention is directed to a method of performing a cycling exercise in the supine position. The method comprises selecting a mode of exercise on the supine rotary exercise machine of the present invention; positioning the exerciser's body in a supine position, and placing the exerciser's feet on said pedals; and performing a cycling exercise with a reciprocating motion or a parallel motion of the exerciser's feet/legs, depending on said mode of exercise selected. The method further comprises selecting a different mode of exercise by reversing said at least one crankarm from said orientation positioned in the first mode of exercise, and perform another cycling exercise different from the first mode of exercise.

The method further comprises attaching two elongated extension shafts to outer sides of corresponding pedals, and holding opposing second ends of said extension shafts with the exerciser's hands, and performing a selected mode of exercise with the arms of the exerciser moving in the same motion of the feet/legs.

The advantages of the present invention will become apparent from the following description taken in conjunction with the accompanying drawings showing exemplary embodiments of the invention.

BRIEF DESCRIPTION OF THE DRAWINGS

It is noted that in the drawings like numerals refer to like components.

DETAILED DESCRIPTION OF THE INVENTION

Figure 1:
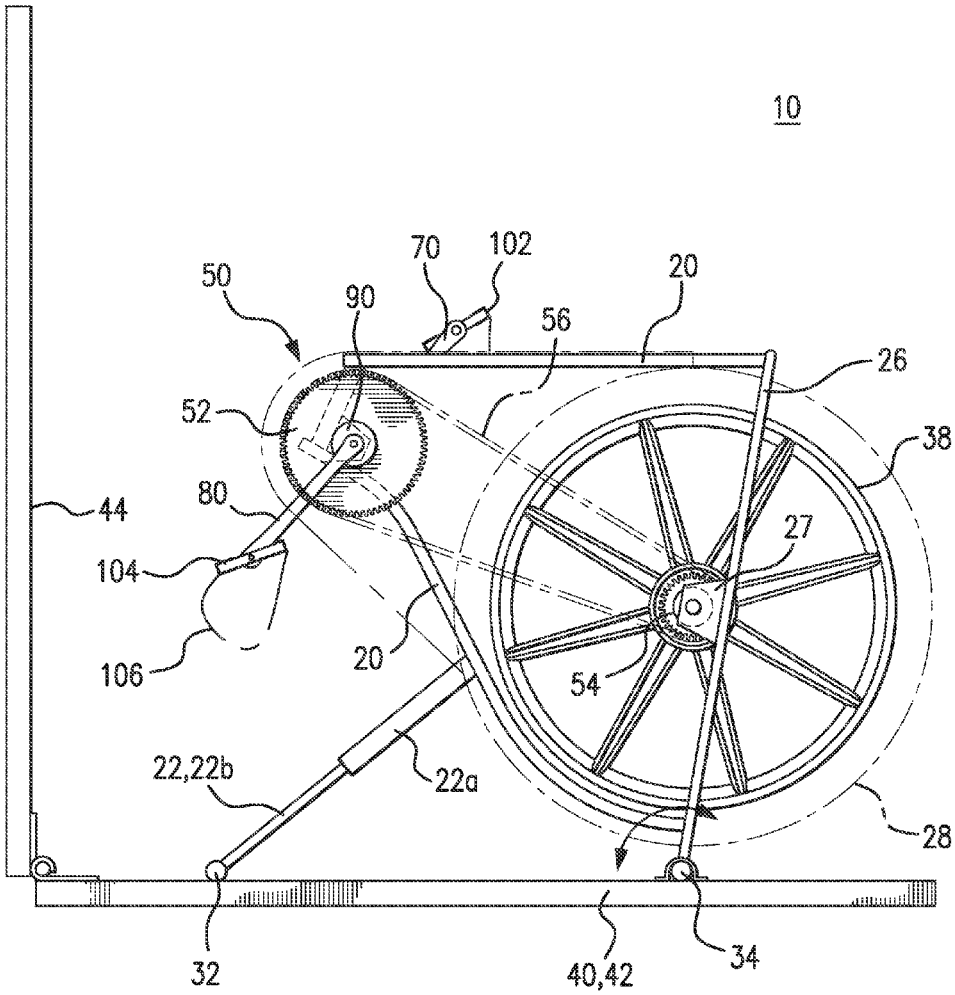
FIG. 1 is a right side view of a supine cycling exercise machine in one embodiment of the present invention.
Figure 2:
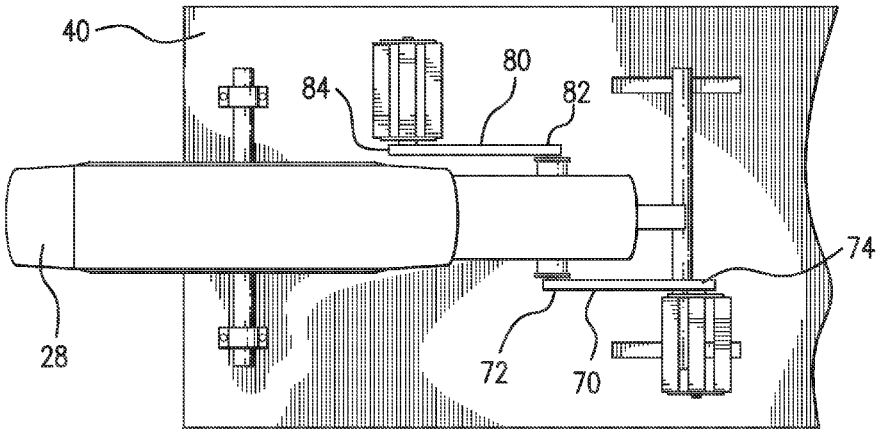
FIGS. 2 and 2A are top views of the exercise machine shown in FIGS. 1 and 1A, with two crankarms positioned in the opposing and parallel orientations, respectively.
Figure 2A:
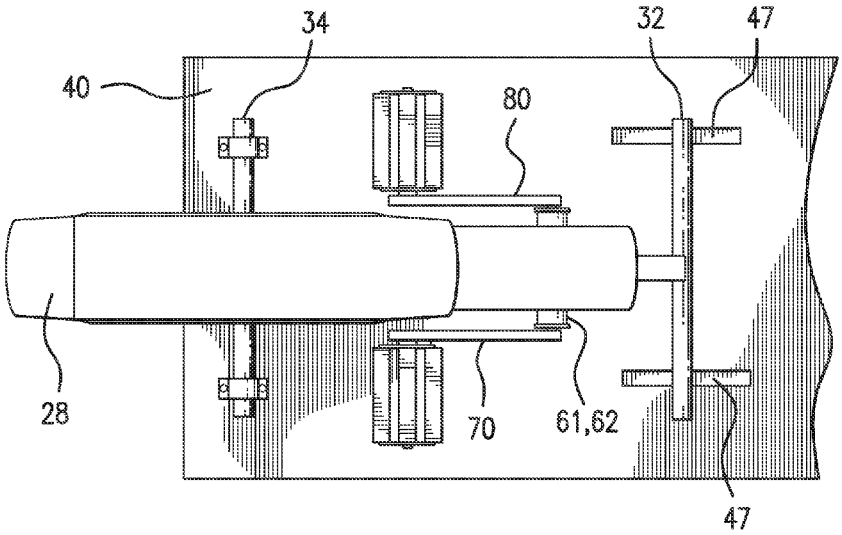

In one aspect, the present invention provides a supine cycling exercise machine. Referring now to FIGS. 1 through 2A, in one embodiment supine cycling exercise machine 10 includes a frame 20 disposed on a horizontal base 40 and a rotation driving assembly 50 supported by frame 20.

As shown in FIG. 1, frame 20 includes a front support beam 22 and a pair of rear support beams 26 on two sides of a rear wheel 38. Front support beam 22 has its upper end affixed to the front side of frame 20 and its lower end affixed to a horizontal front base bar 32. Rear support beams 26 having the lower ends thereof connected to a horizontal rear base bar 34. Preferably, front support beam 22 is adjustable in length, which allows the user to adjust the distance of pedals from the body according to the length of the user's legs. In the embodiment shown, front support beam 22 has a telescoping structure, and its length can be adjusted by the user by adjusting the relative position between the upper beam 22*a* and lower beam 22*b*. The rear support beams 26 can be configured tiltable relative to base bar 34, for example, having a hinged joint in the rear support beams, or having a pivotable connection with the base bar, which maintains the exercise machine in balance when front support beam 22 is adjusted. Alternatively, base bar 34 may have a cylindrical shape to permit tilting of rear support beams 26 on horizontal base 40 as shown in FIG. 1.

Figure 9:
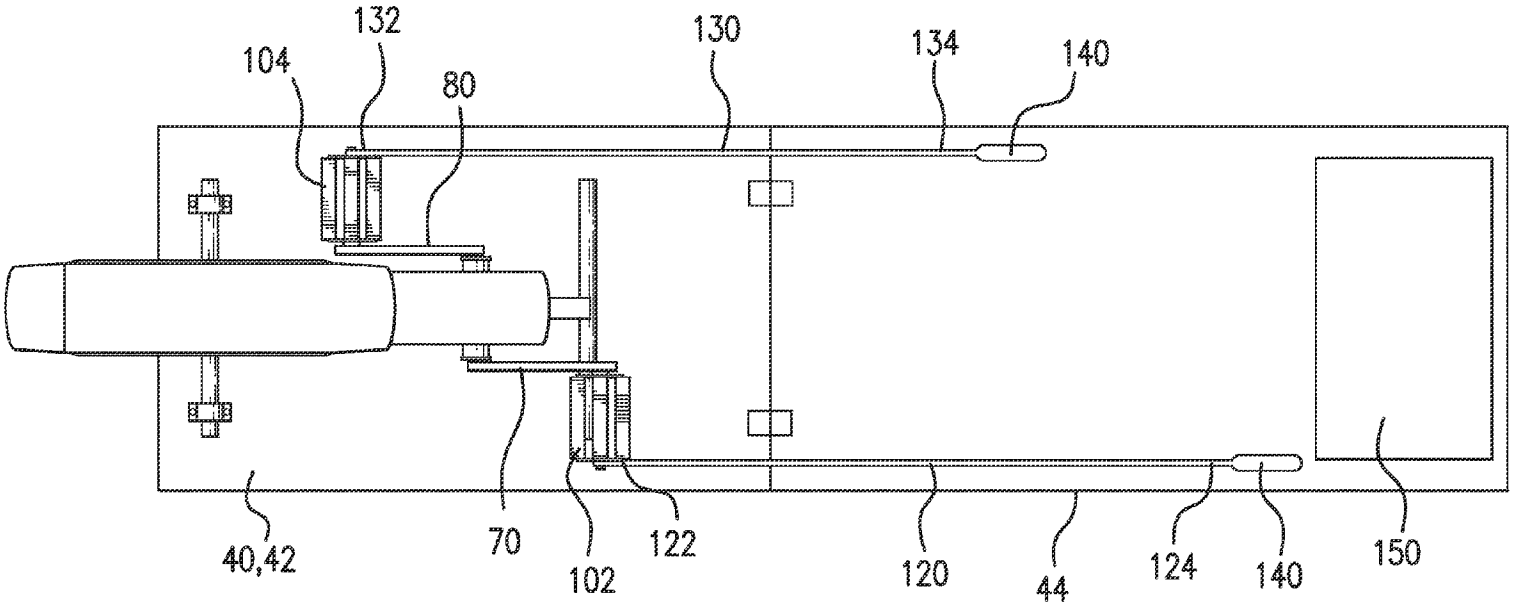
FIG. 9 is a top view of the supine cycling exercise machine in another embodiment of the present invention, showing a pair of elongated extension shafts attached to the outer side of the pedals.
Figure 10:
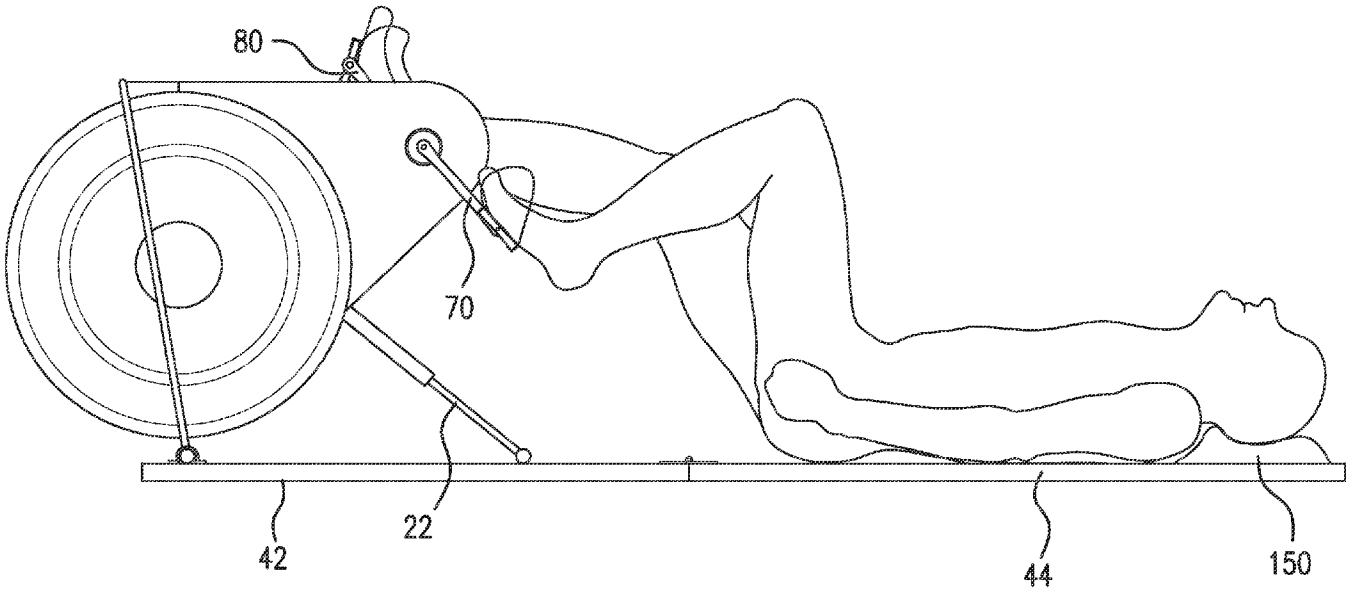
FIG. 10 is an illustrative view of the supine cycling exercise machine of the present invention with a user exercising in the supine position with two feet moving in opposing directions.

Horizontal base 40 can be the floor, or can be in a form of a baseboard. The front and rear base bars 32 and 34 can be connected to baseboard 40. In one embodiment as shown in FIGS. 1, and 9-10, baseboard 40 includes a rear baseboard 42 and a front baseboard 44 attached to rear baseboard 42. In the embodiment shown, frame 20 is attached to rear baseboard 42 and front baseboard 44 is connected to rear baseboard 42 by hinges. As such, baseboard 40 can be in an extended position (as shown in FIG. 10) during exercise, or in a folded position to save space after the exercise. Other alternative configurations can also be used to retrieve the front baseboard when the exercise machine is not in use. Optionally, front baseboard 44 further includes a cushion 150 for supporting a user's head thereon (see FIG. 10).

Figure 1A:
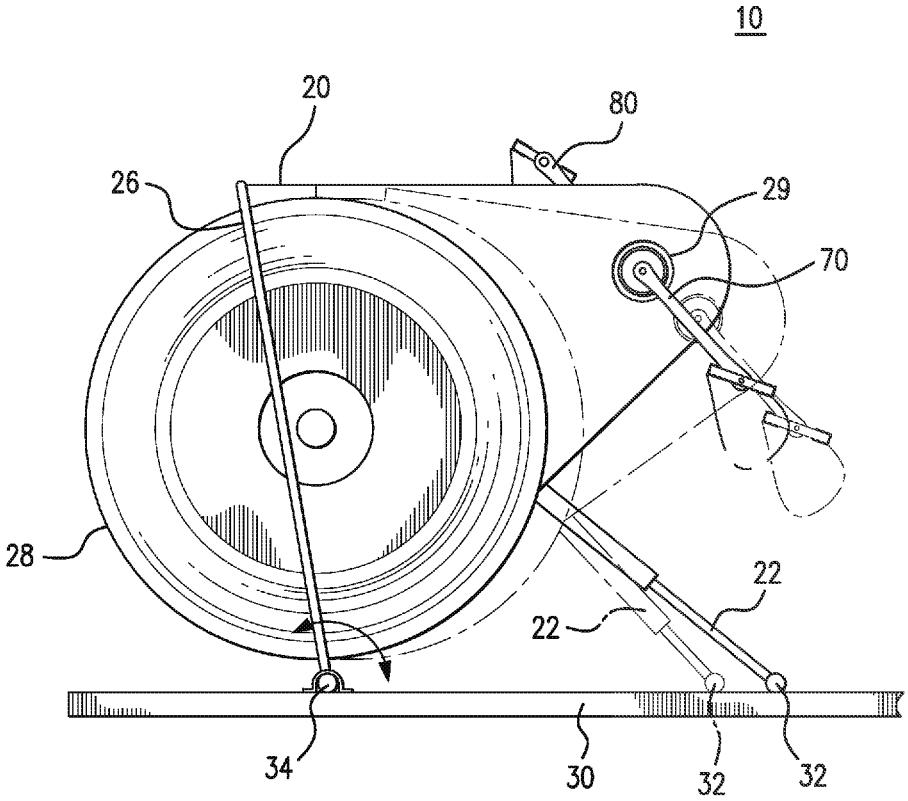
FIG. 1A is a left side view of the supine cycling exercise machine shown in FIG. 1, with a housing covering portions of the machine.

As further shown in FIG. 2A, the upper side of rear baseboard 42 may further include a pair of grooves 47, and the front base bar 32 may further include a pair of engagement elements (not shown) at the bottom of the front base bar 32, which are complimentary and slideably engage with grooves 47. The engagement elements can be locked at a selected position within grooves 47. As shown in FIGS. 1A and 2A, when the length of front support beam 22 is adjusted, the front base bar 32 is moved in the longitudinal direction of the baseboard with the engagement elements sliding along grooves 47, and is then locked at the selected position depending on the length of the user's legs. Other alternative configurations can also be used to move and lock the front support beam 22 on the rear baseboard.

As shown in FIGS. 1 and 2-2A, rotation driving assembly 50 includes a rotatable crankshaft 62 and two crankarms 70, 80 with proximal ends 72, 82 thereof attached to opposing ends of crankshaft 62, with a pair of pedals 102, 104 rotatably connected to distal ends 74, 84 of crankarms 70, 80. Optionally, pedals further include fastening or holding means 106 adapted to retain the user's feet on the pedals.

Crankshaft 62 is a part of a crankshaft assembly which further includes a crankshaft shell 61 and ball bearings (not shown). Crankshaft shell 61 is affixed stationary to frame 20. In one embodiment as shown, rotation driving assembly 50 further includes a drive sprocket or wheel 52, and a driven sprocket or wheel 54, operationally connected to crankshaft 62. As shown in FIG. 1, the axis of driven wheel 54 and the large rear wheel 38 is supported by a bracket 27 of the frame 20. The large rear wheel 38 is connected to driven wheel 54. A chain 56 or a belt may be used to interconnect drive wheel 52 and driven wheel 54. When forces are applied on the pair of pedals by the user, crankshaft 62 rotates and enables a cycling exercise. It should be understood that other driving mechanisms, such as those in bicycles and recumbent exercise bikes, can also be used for the purpose of the present invention.

As shown in FIG. 1A, the supine cycling exercise machine 10 may optionally further include a housing 28 secured to frame 20, to enclose rotation driving assembly 50. Housing 28 has a pair of openings 29, and crankarms 70, 80 are connected to crankshaft 60 through openings 29.

As a unique feature of the present invention, rotation driving assembly 50 includes a redirection connection mechanism between the proximal end of at least one crankarm and at least one end of the crankshaft, which allows repositioning at least one crankarm by an exerciser between an opposing and a parallel orientation relative to the other crankarm, as shown in FIGS. 2 and 2A respectively. This enables the exercise machine of the present invention to support two different cycling exercises, as described in detail hereinafter. Preferably, the redirection connection mechanism is configured to enable repositioning of the crankarm by rotation of the at least one repositionable crankarm around the crankshaft, in other words, is a rotational redirection connection mechanism.

Figures 3, 3A:
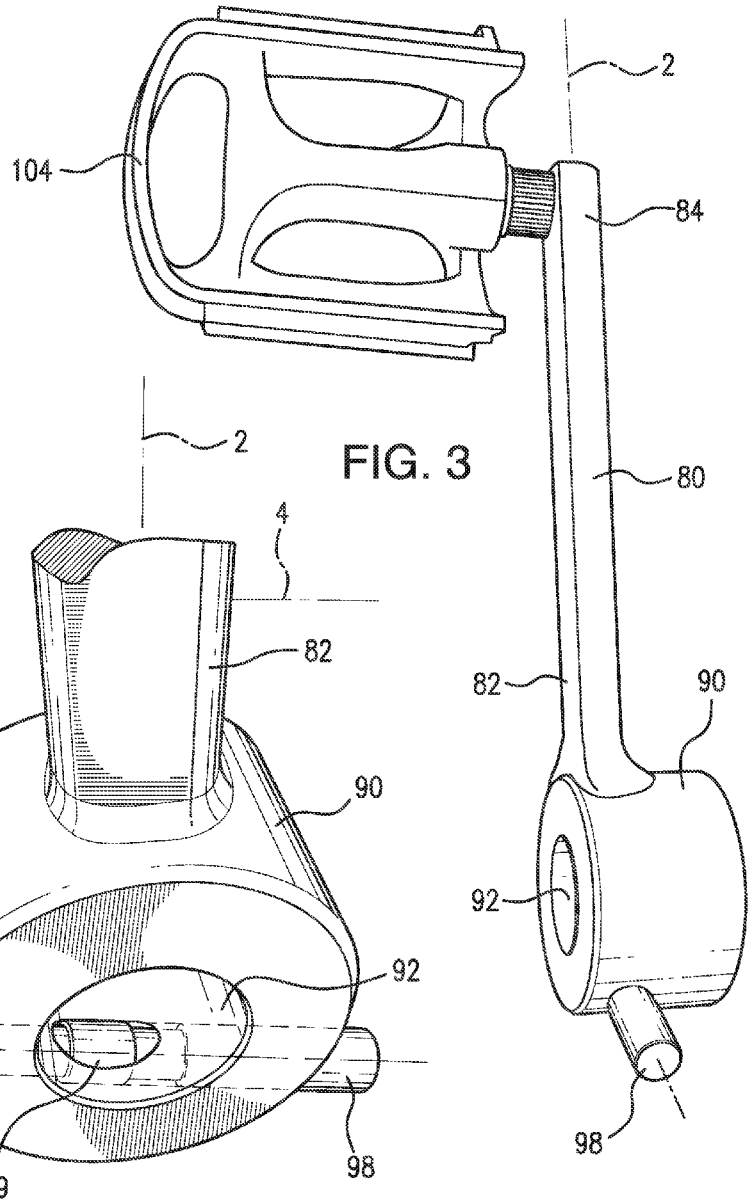
FIG. 3 is a perspective view of a repositionable crankarm in one embodiment of the present invention.
FIG. 3A is an enlarged view of the quick release hub at the proximal end of the repositionable crankshaft in the embodiment shown in FIG. 3.
Figure 4:
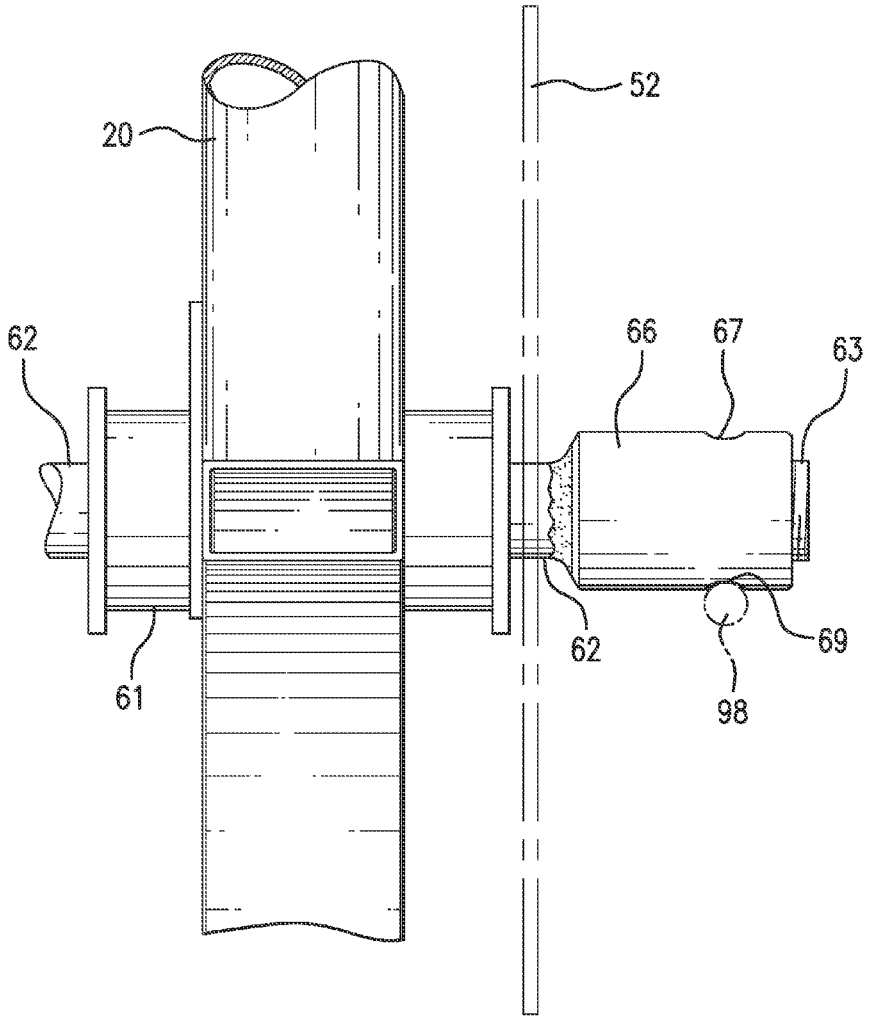
FIG. 4 is an enlarged view showing one end of the crankshaft in the embodiment shown in FIG. 3, which engages with the repositionable crankarm.

FIGS. 3 through 5A show the structure and operating mechanism of a repositionable crankarm 80 in one example embodiment of the present invention. As shown, repositionable crankarm 80 has a quick release hub 90 at proximal end 82, which is integral with the crankarm. Quick release hub 90 has a circular axial bore 92, perpendicular to both the long axis 2 and short axe 4 of the crankarm, and a quick-release pin 98 therein. In this embodiment as shown in FIG. 4, the corresponding end 66 of crankshaft 62 has a cylindrical circumference, with an outer diameter complimentary to the inner diameter of circular axial bore 92 of hub 90. Crankarm 80 can be rotated around cylindrical end 66 by an user to position crankarm 80 in either opposing or parallel orientation relative to crankarm 70.

As further shown in FIG. 4, the end 66 of crankshaft 62 includes two grooves 67, 69 on the two opposing sides of the cylindrical circumference, in perpendicular to the longitudinal axis of crankshaft 62. Grooves 67, 69 are disposed 180 degrees from each other, and are adapted to engage with quick-release pin 98 of hub 90 when crankarm 80 is positioned in the opposing and parallel orientations relative to crankarm 70, respectively.

Figure 5:
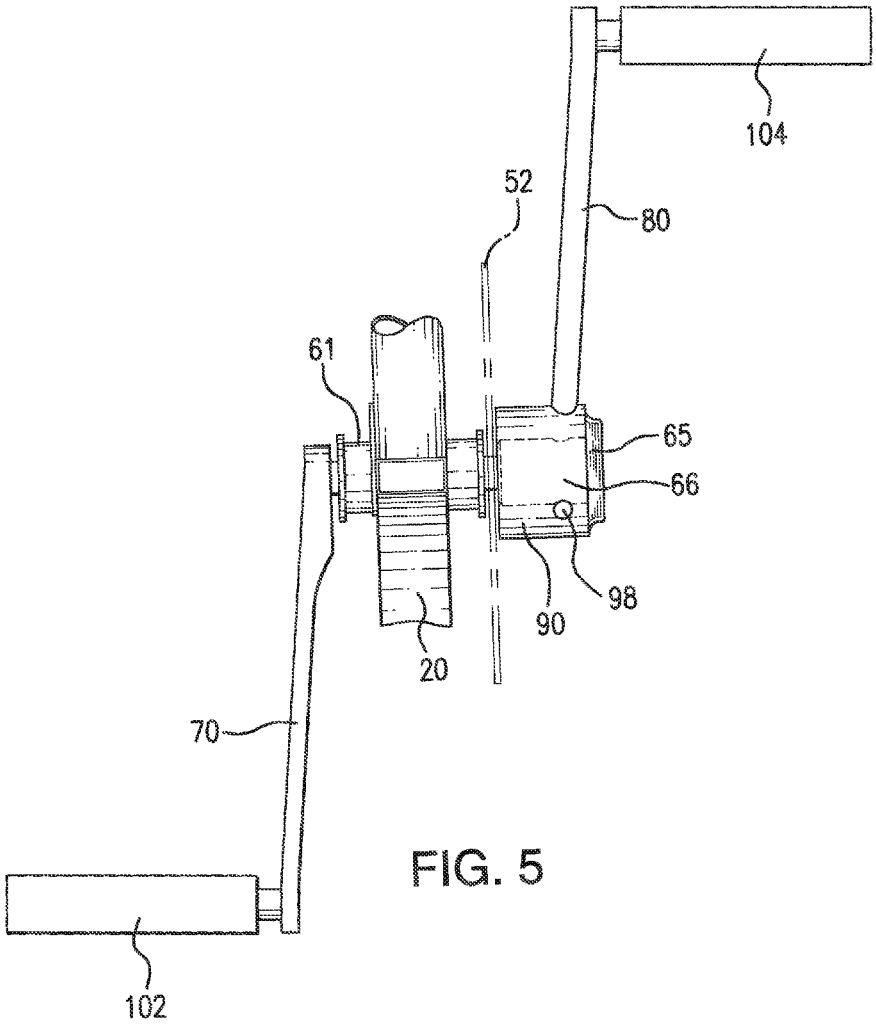
FIGS. 5 and 5A show the crankarms in the embodiment shown in FIG. 3, with the repositionable crankarm connected to the crankshaft in two different orientations.
Figure 5A:
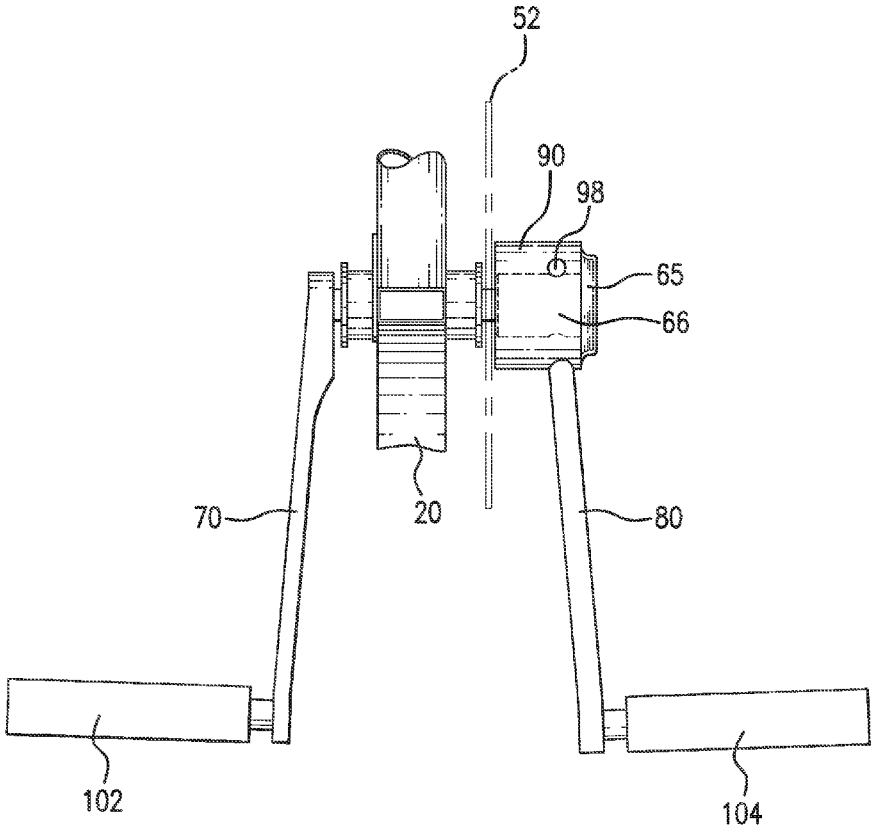

FIG. 3A shows an enlarged view of quick release hub 90, where the quick release pin 98 is in the locking position, with locking element 99 protruding in axial core 92. In the embodiment shown, quick release pin 98 is spring loaded. When pin 98 is pressed down from its top end by a user, locking element 99 is pressed away from axial core 92, which releases the locking engagement between the quick release pin 98 and the end 66 of crankshaft 62. The crankarm 80 can be repositioned by rotating the crankarm around crankshaft 62 while with the quick release pin 98 pressed down. When crankarm 80 is positioned to the desired orientation, quick release pin 98 is released to lock the crankarm onto crankshaft 62 at the selected orientation. FIGS. 5 and 5A illustrate the repositionable crankarm 80 connected to crankshaft 62 in two different orientations.

Preferably, quick release pin 98 is not removable from the hub, such that it can be conveniently operated by a user as a push button. However, other suitable quick release pin mechanisms, such as ball detent pins, threaded detent pins and others, can also be used in the hub in the present invention.

Furthermore, the proximal end of crankarm 80 is preferably retained on the end 66 of crankshaft 62 by a retaining element, such as a nut or locking cap 65 in the longitudinal direction of the crankshaft. As such, when crankarm 80 is re-orientated, crankarm 80 remains on crankshaft 62. The user may simply push quick release pin 98, and then rotate the crankarm around. This is particularly advantageous in terms of user convenience. Moreover, it also reduces wear and tear at the interface between the crankarm and the end of crankshaft with frequent repositioning of the crankarm. In the exemplary embodiment shown in FIGS. 4 and 5, a threaded portion 63 is provided at the extreme outside of the end 66 of crankshaft 62, and a cap 65 is fastened to portion 63. When crankarm 80 is re-orientated, the crankarm is retained on crankshaft 62 by cap 65 without being detached. Other suitable mechanisms adapted to lock the repositionable crankarm on the crankshaft in the longitudinal direction of the crankshaft can also be used for the purpose of the present invention.

Other alternative engagement mechanisms between the crankshaft and the repositionable crankarm may also be used. For example, in an alternative embodiment, the end of crankshaft 62 has a hexagon circumference, and the hub of the repositionable crankarm has an axial bore complimentary in shape and dimension to the end of crankshaft 62. A quick release pin in the hub provides locking between the engaged crankshaft and crankarm. Such an engagement structure may be used when primarily only one mode of exercise is used, or repositioning between the two orientations is not often. When repositioning, the user can remove the crankarm from the crankshaft, and reattach it to the crankshaft with the reversed orientation.

In a further alternative embodiment, one end of the crankshaft may include a quick-release hub or an adapter, which has an axial bore in the direction perpendicular to the longitudinal axis of the crankshaft. The proximal end of one crankarm is complimentary to the axial bore at the end of the crankshaft and can be inserted into the axial bore of the quick-release hub at an orientation either opposing or parallel with the other crankarm.

Figure 6:
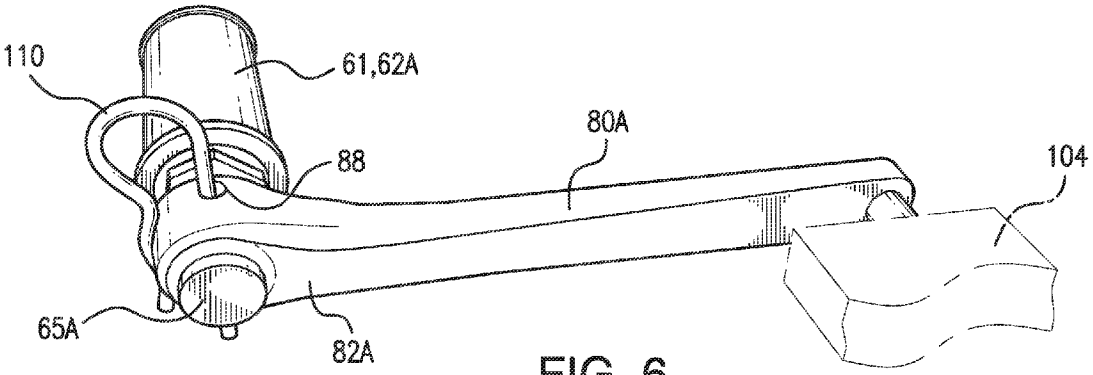
FIG. 6 is a side perspective view of an installed repositionable crankarm in a further embodiment of the present invention, showing the connection between the repositionable crankarm and the crankshaft.
Figure 8:
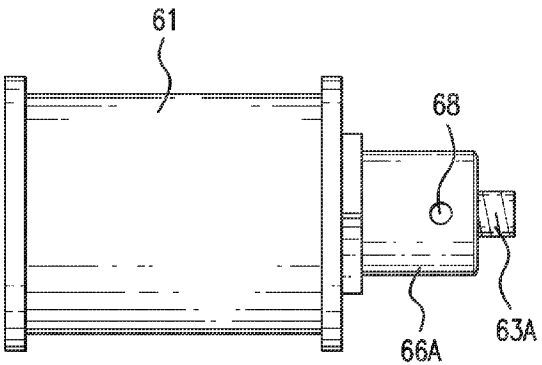
FIG. 8 is an enlarged side view of one end of the crankshaft in the embodiment shown in FIG. 6, which engages with the repositionable crankarm.
Figure 7:
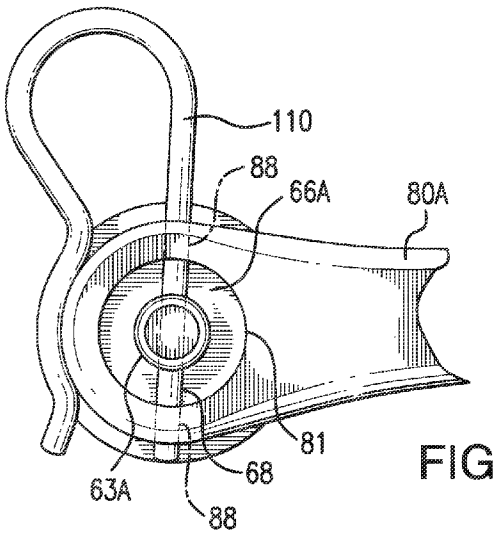
FIG. 7 is an enlarged view of the proximal end of the repositionable crankarm shown in FIG. 6, with the cap removed from the end of the crankshaft.

FIGS. 6-8 illustrate another example embodiment of the redirection connection mechanism between the proximal end of at least one crankarm and at least one end of the crankshaft. As shown, crankarm 80A includes an external locking pin 110 that fastens crankarm 80A on crankshaft 62A. Crankshaft 62A has cylindrical circumference at end 66A and a through-hole 68 in perpendicular to the longitudinal axis of crankshaft 62A, adapted to receive locking pin 110. Crankarm 80A has a circular bore 81 at the proximal end, which as an inner diameter complimentary to the outer diameter of the cylindrical circumference of the end 66A of crankshaft 62A. Crankarm 80A has a through-hole 88 in the direction of its short axis that is in perpendicular to the long axis of the crankarm, and also perpendicular to the axis of the circular bore 81. Through-hole 88 passes through circular bore 81.

When the proximal end 82A of crankarm 80A is attached to crankshaft 62A, through-hole 88 on the crankarm is aligned with through-hole 68 on the crankshaft by rotating the crankarm around the crankshaft, and then locking pin 110 is inserted through the through-holes 88, 68. This locks crankarm 80A on crankshaft 62A at a desired orientation of the crankarm. When crankarm 80A is to be repositioned, the user pulls out locking pin 110, rotates crankarm 80A around crankshaft 62A to the reversed orientation, and then inserts locking pin 110 back into the through-holes to fasten the crankarm 80A.

As further shown in FIG. 6, preferably the proximal end 82A of crankarm 80A is fastened to end 66A of crankshaft 62A, in the longitudinal direction of the crankshaft. In the embodiment shown, a threaded portion 63A is provided at the extreme outside of the end 66A (see FIG. 8), and a cap 65A is fastened to portion 63A. As such, when crankarm 80A is re-orientated, the crankarm is retained on crankshaft 62A without being detached.

Moreover, the exercise machine may include one or more alignment indicators marked on the external surface of the proximal end of the repositionable crankarm and at the corresponding end of the crankshaft in each of the embodiments described above, to assist alignment for each orientation.

FIG. 9 illustrates a further embodiment of the present invention. Optionally, the exercise machine 10 further includes a pair of elongated extension shafts 120, 130, with first ends 122, 132 thereof rotatably attached to the outer side of pedals 102, 104, respectively. Optionally, a handle 140 is provided to each extension shaft at its second end 124, 134. The extension shafts 120, 130 are detachable from the pedals by the user, and are only attached to the exercise machine at the user's choice. Preferably, extension shafts 120, 130 are adjustable in length, which permits a user to adjust according to his or her arm length. Extension shafts 120, 130 enable the user to exercise his or her arms and shoulders, during the cycling exercise, as further described later.

Additionally, the exercise machine further includes a mechanism for adjusting the resistance of the cycling exercises. Various known resistance adjustment mechanisms used in bicycles and recumbent bikes can be used for the purpose of the present invention. The resistance can be adjusted mechanically by the user, or can be adjusted using an electronic control panel of the exercise machine.

Moreover, the exercise machine may optionally include an automatic driving device which is operably connected to the rotation driving assembly 50 and the control panel. The automatic driving device is powered by electricity and provides an automatic cycling movement (in either motion described above). With the automatic driving device, the user can exercise in a passive manner, namely the movement of the legs are driven by the machine. This is particularly useful for patients who are in recovery from surgery or illness and do not have sufficient strength to sustain the exercise, or for those who need assistance in joint movement.

Figure 11:
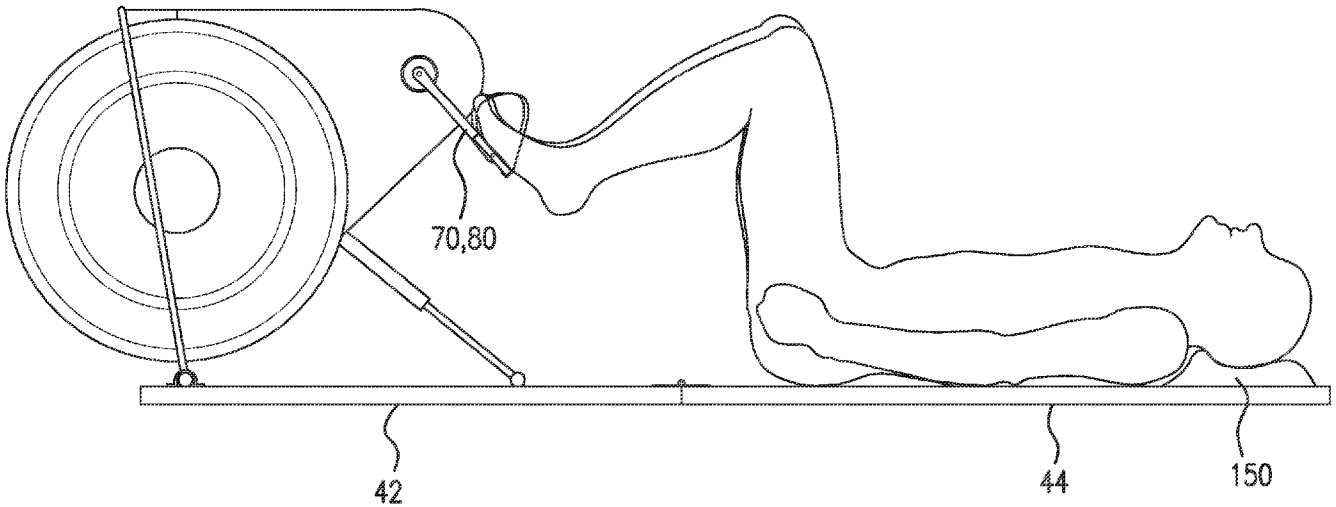
FIG. 11 is an illustrative view of the supine cycling exercise machine of the present invention with a user exercising in the supine position with two feet moving in the same direction.
Figure 12:
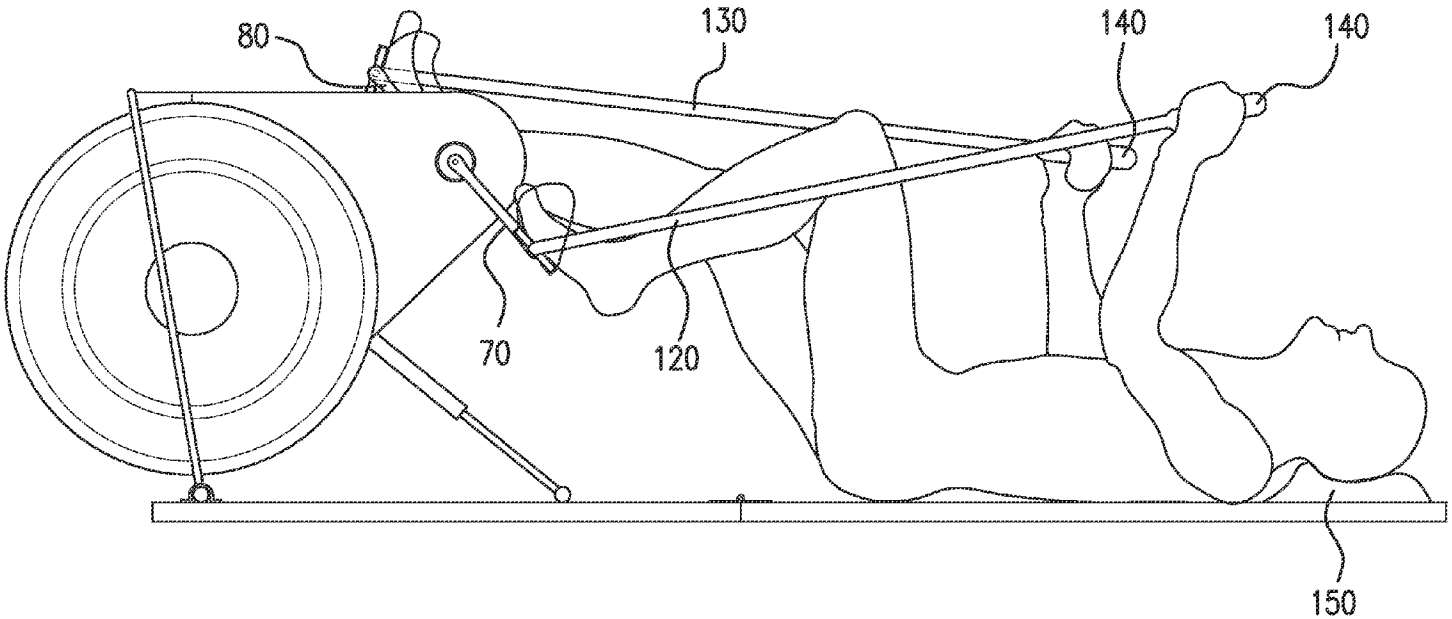
FIG. 12 is an illustrative view showing a user exercising using elongated extension shafts attached to the pedals.

FIGS. 10-12 illustrate the method of using the exercise machine of the present invention to exercise. As shown in FIGS. 10 and 11, the exercise machine of the present invention can be used for two different modes of cycling exercises in the supine position. One mode involves reciprocating motion of the exerciser's feet, like the motion of regular biking, as shown in FIG. 10. The other mode involves parallel motion of the exerciser's feet, as shown in FIG. 11. Before starting the desired mode of exercise, the user positions the repositionable crankarm 80 or 80A to a selected orientation, either opposing, or in parallel with, crankarm 70, according to the mode of exercise. As described above, to position crankarm 80, the user presses down the quick release pin 98 of hub 90 and rotates crankarm 80 to the selected orientation, then releases pin 98 to lock crankarm 80 at the selected orientation. Similarly, to position crankarm 80A, the user removes locking pin 110 from the crankarm and rotates crankarm 80A to the selected orientation, then inserts locking pin 110 into the through-holes to lock crankarm 80A at the selected orientation.

Once the orientation of crankarm 80 or 80A is set, the user lies down on the front baseboard 44 in the supine position, with two feet placed on the pedals to perform a cycling exercise. The exercise involves either a reciprocating motion or a parallel motion of the exerciser's feet and legs as illustrated in FIGS. 10 and 11, respectively, depending on the mode of exercise selected.

After finishing the first mode of exercise, the user can change the orientation of the repositionable crankarm 80 or 80A by releasing the locking mechanism, rotating the crankarm to an orientation is reverse of that used in the first mode, and then locking the crankarm at this second selected orientation in the manner described above. Then, the user can perform a second mode of exercise as illustrated in FIG. 10 or 11, which is different from the first mode.

It has been found that the supine position cycling exercise enabled by the exercise machine of the present invention is particularly effective in abdominal and lower back exercises. The exercise is substantially more effective in strengthening the abdominal muscles and reducing the size of abdomen than the exercise using traditional recumbent bikes or traditional bicycles. The exercise also effectively strengthens the lower back muscles, which helps to reduce back pain. Moreover, the two different cycling exercises, namely reciprocating motion or parallel motion of the user's feet and legs, provide workout of different muscles. Therefore, the exercise machine of the present invention enables multiple exercises that are not supported by traditional recumbent bikes or traditional bicycles. Furthermore, as can be appreciated, the cycling exercises also provide two different modes of workout of the user's legs.

In a further embodiment as illustrated in FIG. 12, the two elongated extension shafts are attached to the outside of the pedals. During the exercise, two hands of the user hold on the second ends 124,134. The cycling exercises now further include motion of the exerciser's arms. As described above, when the crankarm 80 or 80A is positioned for one selected mode of cycling exercise, for example, reciprocating motion as shown in FIG. 12, now the arms of the user are driven by the pedals and move in the same motion of the feet. Then, when the crankarm 80 or 80A is repositioned for the other mode of cycling exercise, namely parallel motion, again the arms of the user are driven by the pedals and move in the same parallel motion of the feet. Therefore, in either mode of exercises, the user's arms are moved in the same motion of the feet. This provides workout of the arms and shoulders at the same time of the workout of the abdomen and legs. Therefore, the exercise machine of the present invention is multifunctional. As can be appreciated, in this embodiment the user can also push the extension shafts by hands to help driving the cycling movement if desired.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A supine cycling exercise machine comprising:

a frame, disposed on a horizontal base;

and a rotation driving assembly supported by said frame, said driving assembly comprising a rotatable crankshaft extending through a sprocket wheel, and two crankarms with proximal ends thereof attached to opposite ends of said crankshaft and distal ends thereof attached to two pedals; at least one end of the crankshaft having two grooves on circumference of the crankshaft, disposed opposite each other, each groove in perpendicular to a longitudinal axis of the crankshaft; at least one crankarm having a quick-release hub at a proximal end thereof, with said at least one end of the crankshaft disposed in an axial bore of the quick-release hub; the quick-release hub having a quick-release pin engaging with one or the other of said two grooves on the crankshaft, thereby locking said at least one crankarm onto the crankshaft at either an opposing or a parallel orientation relative to the other crankarm, thereby said exercise machine enables two different cycling exercises.

2. The exercise machine of claim 1, wherein said cycling exercises include reciprocating motion or parallel motion of the exerciser's feet.

3. The exercise machine of claim 1, wherein the quick-release pin of the quick-release hub is spring loaded, and pressing the quick-release pin releases a locking engagement between the quick-release hub and the crankshaft.

4. The exercise machine of claim 1, wherein said axial bore of the quick-release hub is circular, and said at least one end of crankshaft is cylindrical, complimentary to said circular axial bore of said quick-release hub, thereby said at least one crankarm can be reversed by rotating around said at least one end of said crankshaft.

5. The exercise machine of claim 4, wherein said exercise machine further includes a retaining element, retaining said at least one crankarm to said crankshaft in a longitudinal direction of said crankshaft, thereby when said at least one crankarm is reversed by rotation, said at least one crankarm is retained on said crankshaft.

6. The exercise machine of claim 5, wherein said retaining element is a locking cap or a nut disposed at the end of the crankshaft.

7. The exercise machine of claim 1, wherein said exercise machine further includes one or more alignment indicators marked on external surface of said proximal end of said at least one crankarm and said at least one end of said crankshaft to assist alignment of said at least one crankarm at either orientation.

8. The exercise machine of claim 1, wherein said horizontal base includes a rear base board with said frame affixed thereon and a front base board foldably attached to said rear base board; and at an unfolded position the front base board provides a support for a user in a supine position.

9. The exercise machine of claim 1, wherein said exercise machine further comprises two elongated extension shafts, each having one end thereof removably attached to an outer side of a corresponding pedal.

10. The exercise machine of claim 9, wherein said cycling exercises further include reciprocating motion or parallel motion of the exerciser's arms.

11. A method of performing a cycling exercise in supine position, comprising:

(a) selecting a mode of exercise on a supine rotary exercise machine, said exercise machine comprising a frame disposed on a horizontal base, and a rotation driving assembly supported by said frame, said driving assembly comprising a rotatable crankshaft extending through a sprocket wheel, and two crankarms with proximal ends thereof attached to opposite ends of said crankshaft and distal ends thereof attached to two pedals; at least one end of the crankshaft having two grooves on circumference of the crankshaft, disposed opposite each other, each groove in perpendicular to a longitudinal axis of the crankshaft; at least one crankarm having a quick-release hub at a proximal end thereof, with said at least one end of the crankshaft disposed in an axial bore of the quick-release hub; the quick-release hub having a quick-release pin engaging with one or the other of said two grooves on the crankshaft, thereby locking said at least one crankarm onto the crankshaft at either an opposing or a parallel orientation relative to the other crankarm; wherein said selecting a mode of exercise is effected by positioning said at least one crankarm in either said opposing or parallel orientation relative to the other crankarm;

(b) positioning an exerciser's body in a supine position, and placing the exerciser's feet on said pedals; and (c) performing a cycling exercise with a reciprocating motion or a parallel motion of the exerciser's feet, depending on said mode of exercise selected in (a).

12. The method of claim 11 further comprising:

selecting a different mode of exercise by pressing the quick-release pin to release a locking engagement between the quick-release hub and the crankshaft, and then reversing said at least one crankarm from said orientation positioned in (a); and repeating (b) and (c) to perform another cycling exercise different from said mode of exercise selected in (a).

13. The method of claim 11, wherein said exercise machine further comprises two elongated extension shafts having first ends thereof attached to outer sides of corresponding pedals, and wherein the method further comprises holding opposing second ends of said extension shafts with the exerciser's hands, and performing said mode of exercise with the arms of the exerciser moving in a same motion of the feet.

14. The method of claim 13 further comprising:

selecting a different mode of exercise by reversing said at least one crankarm from said orientation positioned in (a);

holding said second ends of said extension shafts with the exerciser's hands; and repeating (b) and (c) to perform another cycling exercise different from said mode of exercise selected in (a), with the arms of the exerciser moving in a same motion of the feet.

* * * * *